US005805957A

United States Patent [19]

Kodama et al.

[11] Patent Number: 5,805,957

[45] Date of Patent: Sep. 8, 1998

[54] IMAGE FORMING APPARATUS

[75] Inventors: Hideaki Kodama; Eiji Nakane, both of Okazaki, Japan

[73] Assignee: Minolta Co., Ltd., Osaka, Japan

[21] Appl. No.: 780,267

[22] Filed: Jan. 8, 1997

[30] Foreign Application Priority Data

Jan. 10, 1996 [JP] Japan ..... 8-002053

[51] Int. Cl.[6] ..... G03G 15/16

[52] U.S. Cl. ..... 399/66; 399/121

[58] Field of Search ..... 399/66, 121, 297, 399/303

[56] References Cited

U.S. PATENT DOCUMENTS 3,877,416 4/1975 Donohue et al. .

4,928,136 5/1990 Kasumoto et al. .

FOREIGN PATENT DOCUMENTS 63-30849 2/1988 Japan .
3-107976 5/1991 Japan .
4-062581 2/1992 Japan .
08-324841 12/1996 Japan .

*Primary Examiner*—Joan H. Pendegrass
*Assistant Examiner*—Quana Grainger
*Attorney, Agent, or Firm*—McDermott, Will & Emery

[57] ABSTRACT

A pressing force adjusting mechanism decreases a pressing force of a pressing member 16 when a leading edge or a rear edge of a transfer material P passes through a transfer point P1 based on the detection signals from a transfer material position sensor 57 and/or a transfer material type sensor 58.

9 Claims, 6 Drawing Sheets

IMAGE FORMING APPARATUS

BACKGROUND OF THE INVENTION

1. Technical Field of the Invention

The present invention relates to an image forming apparatus, in which an image is formed on a transfer material carried by a transfer material carrying member by electrostatically transferring a toner image on a photosensitive member to the transfer material.

2. Description of Related Art

Japanese published unexamined patent application 4-62581 discloses an image forming apparatus with such electrostatic transfer method. It is proposed to deposit a higher density of electrical charges on respective parts of a photosensitive member corresponding to fore and rear ends of a transfer material prior to image transfer. As a result, the electrical charges do not easily flow from the transfer material to the photosensitive member when the transfer material is passing through a transfer section, preventing an unwanted image memory from being formed on the photosensitive member caused by the electrical charges. However, the method of sensitizing parts of a photosensitive member with high electrical charges prior to transfer requires voltage transformation from a low level to a high level, causing increase in the cost. Also, high output voltage of a transfer charger results in more generation of ozone.

Japanese published unexamined patent application 3-107976 and Japanese published unexamined utility model application 63-30849 disclose a method of pressing a transfer material through a transfer material carrying member to a photosensitive member by a pressing member to accomplish a stable transfer. In such method, however, there still remains the problem of paper jam caused by the transfer material which is often stuck to and wound up around the photosensitive member depending on changes in ambient condition.

U.S. Pat. No. 3,877,416 discloses a method of adjusting a transfer bias for transferring a toner image from a photosensitive member to an intermediate transfer material according to differences in sheet resistance corresponding to different kinds of sheets. However, a so called "blanked center phenomenon" is still often seen wherein central parts of letters, points, and fine lines constituting a toner image are not fully transferred, especially when an OHP sheet or a thick paper is used.

BRIEF SUMMARY OF THE INVENTION

In view of the foregoing, it is a primary object of the present invention to provide an image forming apparatus which is capable of producing high-quality images stably without the problems described above.

To accomplish the above said object, an image forming apparatus of the present invention comprises: an image bearing member; a moving member holding a transfer material; a pressing member for pressing the moving member to the image bearing member, the pressing member being capable of changing a pressing force; a detector for recognizing a leading edge position of the transfer material conveyed by the moving member toward a transfer section; and a pressing force adjusting mechanism for decreasing a pressing force of the pressing member when a leading edge of the transfer material passes through the transfer section.

In accordance with the detection of the leading edge of the transfer material, the pressing force of the pressing member is decreased by the pressing force adjusting mechanism in order to reduce the curve rate of the moving member. The transfer material is prevented from being stuck around the image bearing member by electrostatical attraction, thereby preventing a paper jam.

In another aspect of the present invention, an image forming apparatus comprises: an image bearing member; a moving member holding a transfer material; a pressing member for pressing the moving member to the image bearing member, the pressing member being capable of changing a pressing force; a detector for recognizing a rear edge position of the transfer material conveyed by the moving member toward a transfer section; and a pressing force adjusting mechanism for decreasing a pressing force of the pressing member when a rear edge of the transfer material passes through the transfer section.

The pressing force is decreased based on the detection to bring the transfer material and the photosensitive member into less close contact, which reduces separation discharge therebetween and prevents electrical charges from flowing to the photosensitive member.

In a further aspect of the present invention, an image forming apparatus comprises: an image bearing member; a moving member holding a transfer material; a pressing member for pressing the moving member to the image bearing member, the pressing member being capable of changing a pressing force; a detector for judging a type of the transfer material conveyed by the moving member toward a transfer section; and a pressing force adjusting mechanism for changing a pressing force of the pressing member corresponding to a detected type of the transfer material when the transfer material passes through the transfer section.

The pressing force is adjusted according to the detection to prevent blanks in images caused by too much pressing force especially when a thick sheet or an OHP sheet is used. Together with the prevention of paper jam and unwanted image memories as described above, an image forming apparatus of the present invention realizes a stable and optimum image forming.

DETAILED DESCRIPTION OF THE INVENTION

Figure 6:
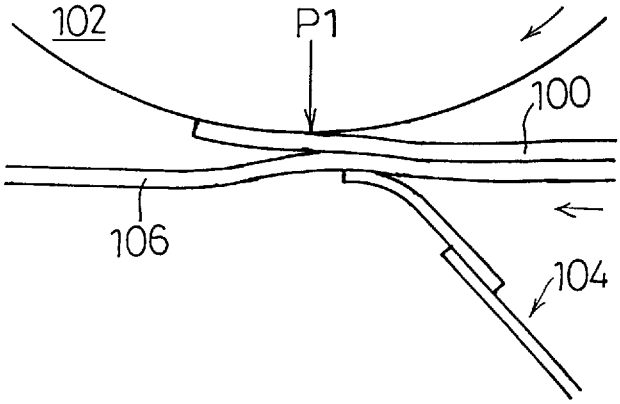
Fig. 6 PRIOR ART
FIG. 6 is an enlarged view showing a transfer section of a conventional image forming apparatus.

FIG. 6 shows how a leading edge of a transfer material 100 is pressed to a photosensitive member 102 with a normal pressing force. A pressing member 104 presses the transfer material 100 from under a transfer material carrying belt 106 to the photosensitive member 102, pushing the transfer material carrying belt 106 upward. The transfer material carrying belt 106 is deformed to form an upward curve at a transfer point P1. The curve rate of the transfer material carrying belt 106 is relatively large as shown in FIG. 6 in a normal pressing condition. When the transfer material carrying belt 106 is curved as shown in FIG. 6 at the time when the leading edge of the transfer material 100 reaches the transfer point P1, the leading edge of the transfer material 100 is apt to avert from the curve, being electrostatically attracted to the photosensitive member 102, separating from the transfer material carrying belt 106 and wound up around the photosensitive member 102, causing paper jam and obstructing stable image forming.

Figure 7:
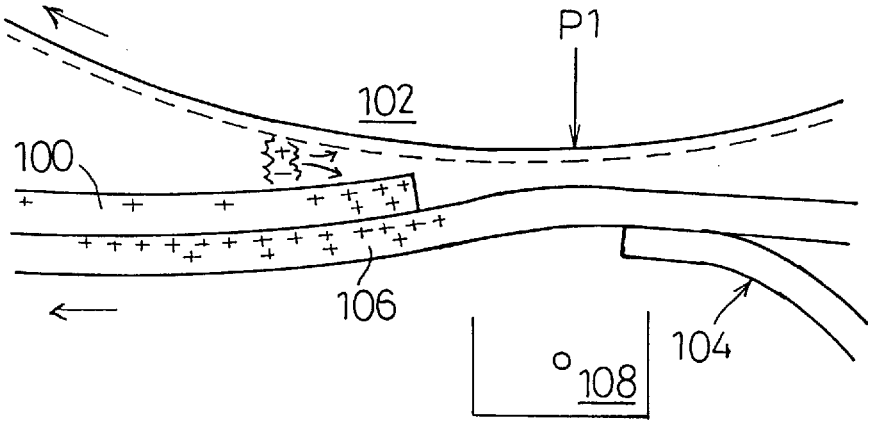
Fig. 7 PRIOR ART
FIG. 7 is an explanatory view showing how electrical charges flow from a rear end of a transfer material to a photosensitive member in the transfer section of FIG. 6.

If the pressing force is uniformly exerted in such normal pressing condition, electrical charges flow from the transfer material 100 to the photosensitive member 102 when the transfer material 100 passes through the transfer point P1, causing image memories on the photosensitive member 102. FIG. 7 shows a view when a rear edge of the transfer material 100 passes through the transfer point P1. Especially when the transfer material 100 contains a high percentage of water and voluminal resistance of the transfer material 100 is decreased under an ambient condition with high humidity, positive charges from a transfer charger 108 tend to flow through the transfer material carrying belt 106 into the transfer material 100, and mostly accumulated in the rear edge of the transfer material 100. The accumulated positive charges create a high voltage electric field between the transfer material 100 and the photosensitive member 102, which causes a separation discharge when the rear edge of the transfer material 100 detaches from the photosensitive member 102 as shown in FIG. 7. Consequently, generated negative charges flow into the transfer material 100 whereas the positive charges flow to the photosensitive member 102, damaging it and causing an unwanted image memory thereon.

Moreover, it cannot be fully prevented by controlling transfer output corresponding to types of transfer material 100 that central parts of toner images such as letters, points and fine lines often fail to be transferred when an OHP sheet or other thick paper is used. According to the experiments conducted by the inventors, this "blanked center phenomenon" is more often seen when an OHP sheet is used than when a thick transfer material is used. It is also known that central parts of images are more likely to be left out when the transfer material 100 is too strongly pressed to the photosensitive member 102 by the pressing member 104.

Preferred embodiments of the present invention to overcome the above described problems will be hereinafter described in conjunction with the accompanying drawings.

(First Embodiment)

Figure 1:
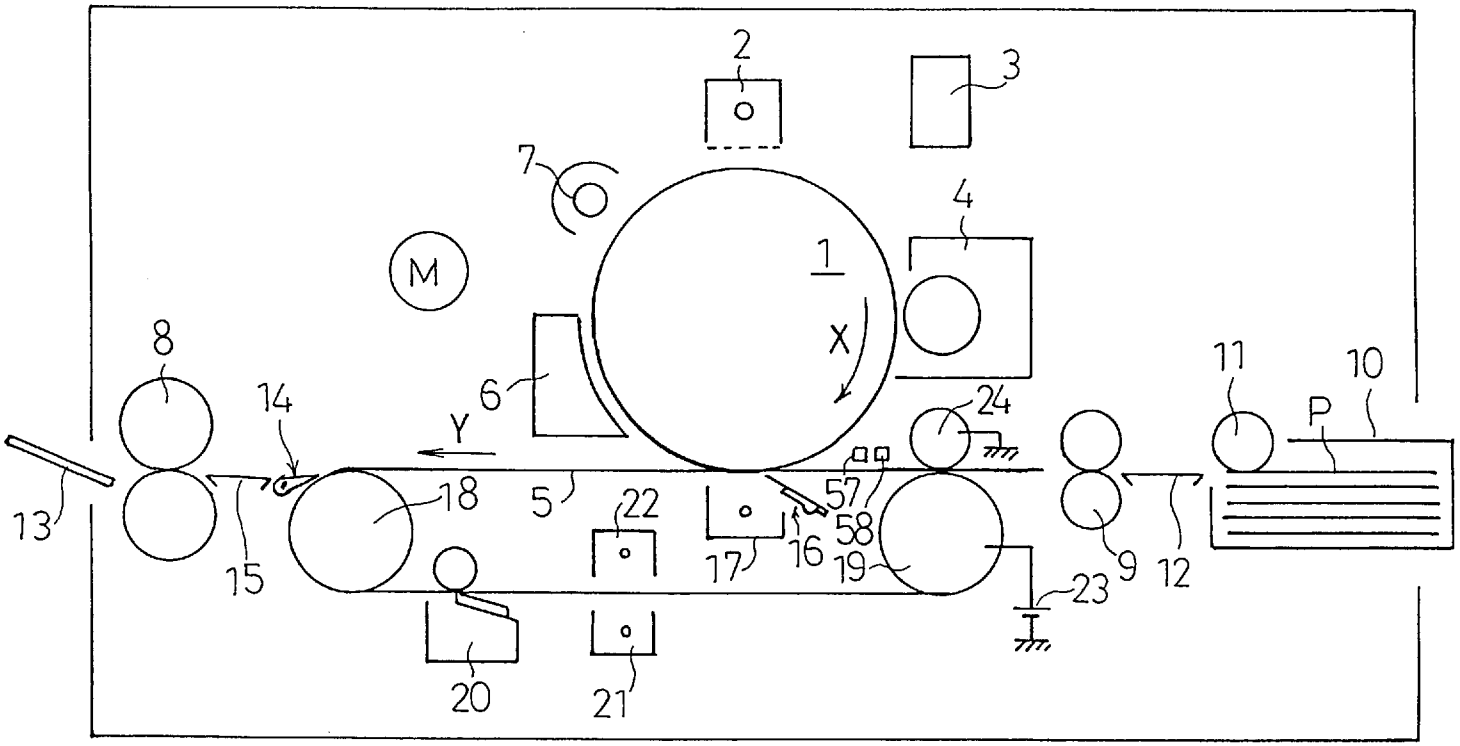
FIG. 1 is a sectional view of an image forming apparatus employing a transfer belt according to a first embodiment of the present invention.

FIG. 1 is a sectional view showing a transfer belt type electrophotographic copying machine according to a first embodiment of the present invention. A photosensitive drum 1 serving as an image bearing member is driven to rotate in the direction of arrow X. Around the photosensitive drum 1, there are a corona charger 2, a print head 3, a developing device 4, a transfer belt 5 for conveying a transfer material, a cleaner 6, and an eraser 7 disposed in consecutive order with respect to the rotational direction of the photosensitive drum 1.

The transfer belt 5 is driven in the direction of arrow Y synchronizing with the photosensitive drum 1, and conveys a transfer material P for image transfer from the photosensitive drum 1. The transfer belt 5 consists of a film belt made of polyvinylidene fluorine or polycarbonate, or of a rubber belt made of chloroprene rubber or urethane rubber, and is stretched between a driving roller 18 and a driven roller 19.

There are disposed a pressing member 16 for exerting a pressing force on the transfer material P through the transfer belt 5 to the photosensitive drum 1, a transfer charger 17, a separating pawl 14 for separating the transfer material P from the transfer belt 5, a belt cleaner 20 for cleaning the outer surface of the transfer belt 5, a pair of dischargers 21, 22 for discharging inside and outside surfaces of the transfer belt 5, and an earthed conductive opposing roller 24 in contact with the transfer belt 5 at the side of the driven roller 19, all in consecutive order with respect to the driving direction of the transfer belt 5. The transfer material P conveyed by a feeding roller 11 from a transfer material tray 10 is led by a guide 12 to a timing roller 9, where the transfer material P is synchronized with the photosensitive drum 1, thereafter carried into the nip of the driven roller 19 connected to a direct current source 23 and the earthed opposing roller 24, and electrostatically attracted to the transfer belt 5 driven by the driving roller 18.

Figure 2:
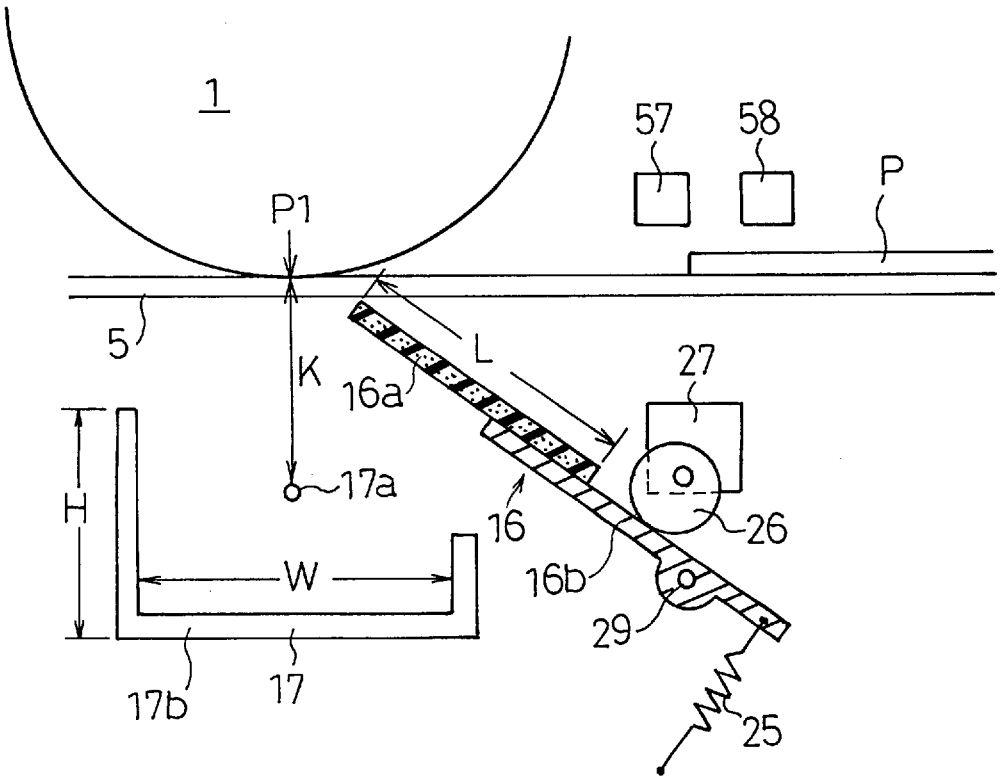
FIG. 2 is an enlarged view showing the vicinity of a transfer section of the image forming apparatus shown in FIG. 1.

Descriptions of a transfer section and how a pressing force adjusting mechanism operates will be made referring to FIG. 2 which shows an enlarged view of its vicinity. The transfer charger 17 is positioned under the photosensitive drum 1 in such a way that a corona charging wire 17*a* opposes to the photosensitive drum 1. As shown in FIG. 2, the photosensitive drum 1 is in opposition to the corona charging wire 17*a* at its bottom, which makes a transfer point P1. The position of the transfer charge 17 is not limited to the arrangement described above. A shield plate 17*b* provided around the corona charging wire 17*a* is made to form a channel having its opening in opposition to the transfer point P1. The pressing member 16 comprises a rear part made of a metal plate 16*b* and a front part consisting of a film 16*a* made of polyethylene telephtalate (PET) of about 200 mm thick attached at a fore end of the metal plate 16*b*. The front part of the pressing member 16 is pivoted around a shaft 29 supporting the metal plate 16*b* to push up the transfer belt 5 by pulling the rear part of the pressing member 16 by the force of a spring 25. The pivotal position of the pressing member 16 can be variously changed by rotating a cum 26 disposed at the back of the metal plate 16*b*, its position being at the fore end side of the pressing member 16 with respect to the shaft 29. The cum 26 is rotated by operation of a stepping motor 27 coupled to the cum 26.

The pressing member 16 is disposed in such a way that the tip of the PET film 16*a* positions a little upstream of the transfer point P1 and the pressing member 16 inclines downward toward the upstream side with respect to the paper feed direction. The film 16*a* covers the opening of the shield plate 17*b* extending thereabove from upstream to the vicinity of the transfer point P1. The film 16*a* overlapping the shield plate 17*b* and extending from its base metal plate 16*b* has the length L of about 13 mm and presses the transfer belt 5 by its resiliency. The film 16*a* also restricts a corona electric field created by the corona charging wire 17*a* of the transfer charger 17 from spreading out to the upstream side of the transfer point P1. This prevents toner particles from scattering at the upstream side of the transfer point P1 which may be induced by the influence of a corona electrical field made by the corona charging wire 17*a*. The internal width W of the shield plate 17*b* is about 14 mm. The higher side wall of the shield plate 17*b* has the height H of about 10 mm, whereas the lower side wall, over which the pressing member 16 extends, is low enough not to interfere with the overlapping pressing member 16. The opposing distance K between the photosensitive drum 1 and the corona charging wire 17*a* is set around 10 mm long.

Figure 3A:
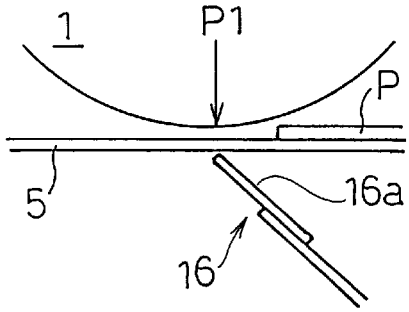
FIGS. 3A, 3B, and 3C show how a pressing member provided in the transfer section shown in FIG. 2 operates.
Figure 3B:
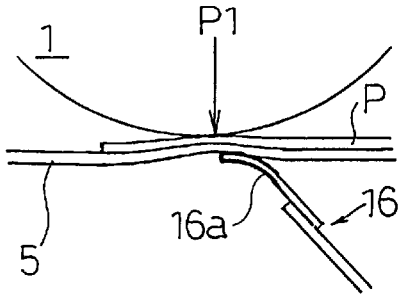

When the leading edge of the transfer material P reaches a transfer material type sensor 58 and is recognized as an ordinary paper, an ordinary paper feed mode is selected. Next, when the leading edge of the transfer material P reaches a transfer material position sensor 57 and is detected, the force exerted by the pressing member 16 is adjusted based on the signal sent by the sensor 57. The pressing member 16 is moved from a first position shown in FIG. 3A to a second position shown in FIG. 3B corresponding to the position of the proceeding transfer material P. As shown in FIG. 3A and 3B, the pressing member 16 slightly touches the back side of the transfer belt 5 at its tip in the first position, whereas in the second position, the bending tip portion pushes up the transfer belt 5, thereby bringing the transfer material P into closer contact with the photosensitive drum 1. The pressing member 16 is moved from the first position to the second position at the time when the leading edge of the transfer material P passes the transfer point P1 about 4–5 mm past.

Figure 4:
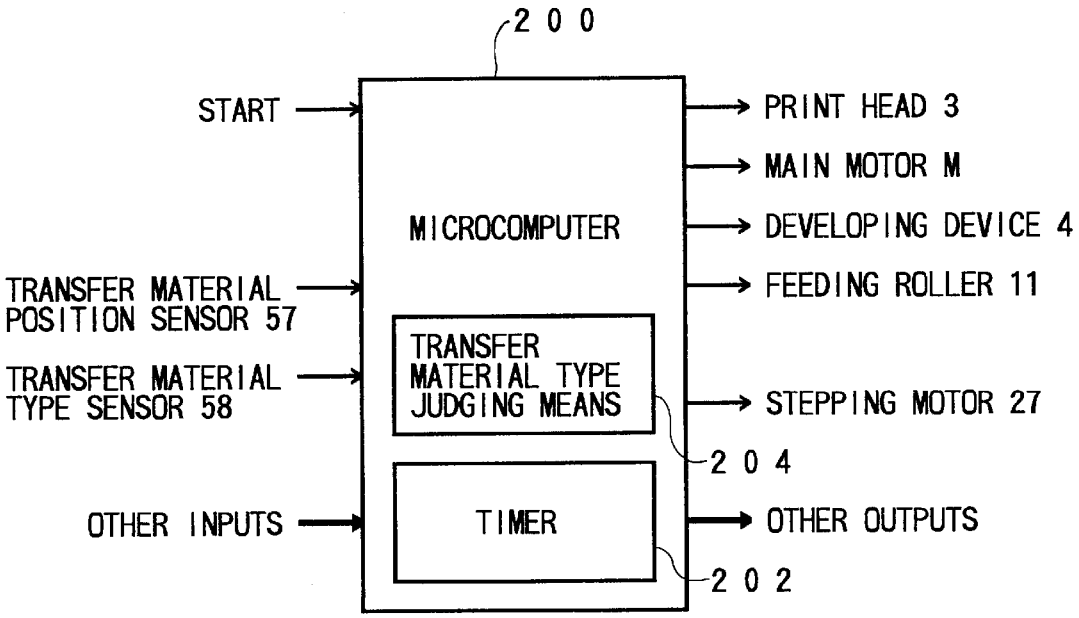
FIG. 4 is a schematic block diagram of a control circuit in the image forming apparatus of FIG. 1.

In order to detect the type and position of the transfer material P and to control the position of the pressing member 16, a microcomputer 200 shown in FIG. 4 is used for operation control. The microcomputer 200 starts a main motor M of the image forming apparatus by a starting signal and consecutively operates the print head 3, the developing device 4, the feeding roller 11, and other components at a predetermined timing. The microcomputer 200 judges whether the transfer material P is an ordinary paper, a thick paper, or an OHP sheet by a transfer material type judging means 204 included within the microcomputer 200 on receipt of detection signals from the transfer material type sensor 58, and selects an ordinary paper mode or a thick paper mode according to the judgment. The transfer material type sensor 58 serving as a detector for judging a type of the transfer material may be variously embodied. For example, the sensor 58 may be provided with a lever which is brought in contact with a carried transfer material P to detect the inclination of the lever changing corresponding to different firmnesses of transfer materials by a photo interrupter. Alternatively, the transfer material type may be detected by measuring a resistance value of the transfer material P passing through the nip of an earthed roller and an electrically charged roller, or also, by measuring transmissivity of the transfer material P. Various types of other configurations may be also employed for the transfer material type sensor 58.

Edge positions of the transfer material are detected as described below. Detection signals from the transfer material position sensor 57 are sent to the microcomputer 200. In order to recognize where the leading edge of the transfer material P positions, an inner timer 202 within the microcomputer 200 counts the time which takes the transfer material P to reach the transfer point P1 from an on-edge, which is a point where the sensor 57 switches from off to on. Likewise, the position of the rear edge of the transfer material P is detected by counting the time which takes the transfer material P to reach a predetermined point from an off-edge, which is a point where the sensor 57 switches from on to off, by the inner timer 202 within the microcomputer 200.

Alternatively, in such a case that sizes of the transfer materials are already set for each paper feeding cassette and both paper edges can be detected thereby, detection of a leading edge or a rear edge of the transfer material P may be made based on a count value by a timer which starts counting at the moment when a feeding operation is started.

Descriptions will be made on how the pressing force is adjusted under the ordinary paper mode. When the pressing member 16 is in the first position shown in FIG. 3A, the gap between the photosensitive drum 1 and the transfer belt 5 at the transfer point P1 is about 0.2 mm. When the leading edge of the transfer material P passes about 4–5 mm past the transfer point P1, the pressing member 16 is moved from the first position to the second position shown in FIG. 3B and presses the transfer belt 5 against the photosensitive drum 1. At the same time electrical charges are supplied from the transfer charger 17 to the transfer belt 5, by which a toner image formed on the photosensitive drum 1 is electrostatically transferred to the transfer material P. An optimum transfer can be accomplished by applying around 4–16 g/cm of linear pressure. To a thicker paper the image is well transferred with the linear pressure of about 4–12 g/cm, and to an OHP sheet with the pressure of about 4 g/cm.

As the transfer material P proceeds and the rear edge is detected to have reached a predetermined point, the pressing member 16 is moved from the second position to the first position based on the detection signals. More particularly, the position change of the pressing member 16 is made when there are 3–4 mm left from the transfer point P1 to the rear edge of the transfer material P.

As described above, by adjusting the pressing force of the pressing member 16, a leading edge of the transfer material P is prevented from being stuck to the photosensitive drum 1, and electrical charges do not flow to the photosensitive drum 1 at the rear edge of the transfer material P, thereby accomplishing an stable and optimum image forming. The function and the effect will be the same if only either one of the leading edge or the rear edge of the transfer material P is detected and the pressing force is adjusted according to the detected information. The transfer material position sensor 57 can thus serve both as a leading edge detector and as a rear edge detector, as well as function as either one of the leading edge detector or the rear edge detector.

The transfer material P bearing the toner image transferred from the photosensitive drum 1 is electrostatically attracted by the transfer belt 5 and conveyed to a point where it is separated from the transfer belt 5 by the separating pawl 14. It is then led by a guide 15 to a fixing device, where the image is fixed by a fixing roller 8 and discharged onto a discharge tray 13.

The belt cleaner 20 cleans the outer surface of the transfer belt 5 after the separation of the transfer material P therefrom, the transfer belt 5 is then discharged both from inside and outside by the dischargers 21, 22, and driven back to attract another transfer material. The dischargers 21, 22 are not absolutely necessary. When, for example, the transfer belt 5 is semiconductive and has about $10^8$ omega/cm of impedance, the belt 5 can be discharged by making the driven roller 18 conductive and earthed, or alternatively, an earthed metal plate or a metal roller may be contacted to the transfer belt 5.

Figure 3C:
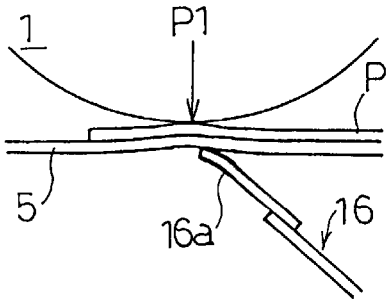

When the transfer material type judging means 204 judges that the transfer material P is a thick paper or an OHP sheet based on a signal from the transfer material type sensor 58, the pressing member 16 is moved from the first position shown in FIG. 3A where the tip of the pressing member 16 just touches the back of the transfer belt 5 to the third position shown in FIG. 3C at the time when the leading edge of the transfer material P passes the transfer point P1 about 4–5 mm past. At the third position, the pressing member 16 adjusts the pressing force and exerts appropriate amount of the force. When the rear edge of the transfer material P reaches the point where the edge positions 3–4 mm before the transfer point P1, the pressing member 16 is moved back to its first position. After that, the transfer material P is separated from the transfer belt 5, fixed, and discharged. By adjusting the pressing force as described above, a stable image forming can be always performed even when the transfer material P is a thick paper or an OHP sheet.

(Second Embodiment)

Figure 5:
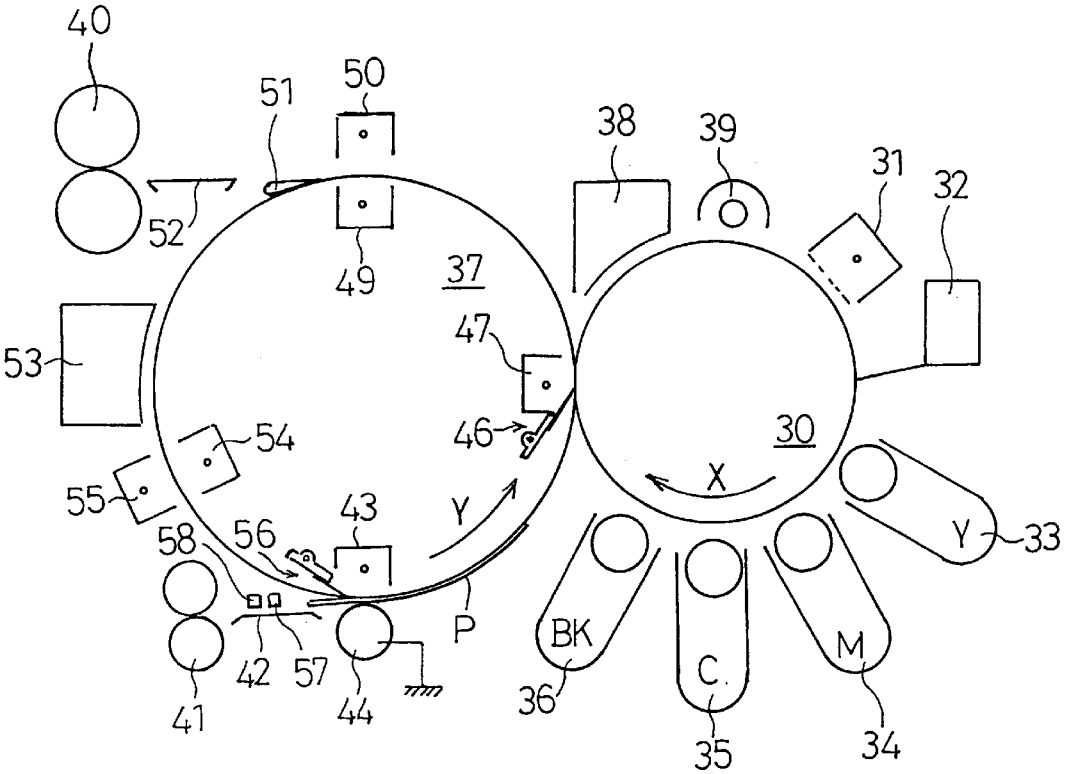
FIG. 5 is a sectional view of a color image forming apparatus employing a transfer drum according to a second embodiment of the present invention.

FIG. 5 shows a whole schematic structure of a transfer drum type color image forming apparatus according to a second embodiment of the present invention. A photosensitive drum 30 as an image bearing member shown in FIG. 5 is driven to rotate in the direction of arrow X. Around the photosensitive drum 30, there are disposed a corona charger 31, a print head 32, developing devices 33, 34, 35, 36, each containing yellow, magenta, cyan, and black developers, a cleaner 38, and an eraser 39 in consecutive order with respect to the rotating direction of the photosensitive drum 30.

A transfer drum 37 carrying a transfer material consists of an elastic, cylindrical drum coated with a transfer film made of polyvinylidene fluorine or polycarbonate and is driven to rotate in the direction of arrow Y in synchronism with the photosensitive drum 30.

An attracting charger 43 and a pressing member 56 are disposed inside the transfer drum 37, and an earthed conductive roller 44 is positioned to oppose thereto. Further disposed surrounding the transfer drum 37 are a pressing member 46 for pressing the transfer material P through the transfer drum 37 to the photosensitive drum 30 at the transfer section, a transfer charger 47 for supplying electrical charges to the interior of the transfer drum 37, a pair of releasing chargers 49, 50, a separating pawl 51, a cleaner 53 for cleaning the outer periphery of the transfer drum 37, and a pair of dischargers 54, 55 for discharging the transfer drum 37 both from inside and outside. The transfer material P is conveyed from a transfer material tray (not shown) to a timing roller 41 which synchronizes the transfer material P with the photosensitive drum 30. Thereafter the transfer material P is led by a guide 42 into the nip of the transfer drum 37 and the earthed conductive roller 44 where it is electrostatically attracted by the transfer drum 37. The pressing member 46 consists of a PET film of about 200 mm attached to a metal plate as in the first embodiment, and its tip pushes up the transfer film around the transfer drum 37 by pivoting around an axis.

The pressing member 46 is moved from the first position to the second or the third position according to the position and type of the transfer material P just as described in the first embodiment. At the first position the tip of the pressing member 46 just touches the transfer film. At the second position the bending tip portion of the pressing member 46 brings the transfer material P into tight contact with the photosensitive drum 30, and at the third position the pressing force is properly decreased and thus the transfer material P comes into less tight contact with the photosensitive drum 30. Accordingly, functions and effects of the pressing member 46 in this embodiment are identical with those of the first embodiment.

A toner image formed on the photosensitive drum 30 is transferred to the transfer material P by electrical charge supply from the transfer charger 47. The toner image transfer operation is repeated four times for each of the four colors by the rotation of the transfer drum 37, and the pressing member 46 similarly repeats its operation four times. Upon completion of the superimposed transfer of the four color visualized images, the transfer material P is separated from the transfer drum 37 by the separating pawl 51, while the releasing chargers 49 and 50 respectively discharge the inner wall of the transfer drum 37 and the transfer material P with the toner image thereon. The transfer material P is then led by a guide 52 into a fixing device, where the image is fixed by a fixing roller 40, and thereafter the transfer material P is discharged onto a discharge tray, not shown.

The outer periphery of the transfer drum 37 is cleaned by the transfer drum cleaner 53 after the transfer material P is released therefrom, and the transfer drum 37 is discharged both from inside and outside by the dischargers 54, 55 to be ready for another cycle of image transfer.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

We claim:

1. An image forming apparatus, comprising:

an image bearing member;

a moving member holding a transfer material;

a pressing member for pressing the moving member to the image bearing member, the pressing member being capable of changing a pressing force;

a detector for recognizing a leading edge position of the transfer material conveyed by the moving member toward a transfer section; and a pressing force adjusting mechanism for decreasing a pressing force of the pressing member when a leading edge of the transfer material passes through the transfer section.

2. An image forming apparatus, comprising:

an image bearing member;

a moving member holding a transfer material;

a pressing member for pressing the moving member to the image bearing member, the pressing member being capable of changing a pressing force;

a detector for recognizing a rear edge position of the transfer material conveyed by the moving member toward a transfer section; and a pressing force adjusting mechanism for decreasing a pressing force of the pressing member when a rear edge of the transfer material passes through the transfer section.

3. An image forming apparatus, comprising:

an image bearing member;

a moving member holding a transfer material;

a pressing member for pressing the moving member to the image bearing member, the pressing member being capable of changing a pressing force;

a detector for judging a type of the transfer material conveyed by the moving member toward a transfer section; and a pressing force adjusting mechanism for changing a pressing force of the pressing member corresponding to a detected type of the transfer material when the transfer material passes through the transfer section.

4. An image forming apparatus, comprising:

an image bearing member;

a moving member holding a transfer material;

a transfer charger disposed in opposition to the image bearing member, the moving member positioning therebetween;

a pressing member disposed at the upstream side of the transfer charger with respect to a moving direction of the moving member, and movable between a pressing position where the pressing member presses the moving member to the image bearing member and a released position where the pressing member is freed therefrom;

a detector for recognizing where a leading edge of the transfer material carried by the moving member positions; and a driving device for moving the pressing member from the released position to the pressing position after the leading edge of the transfer material passes through a point where the image bearing member and the transfer charger oppose to each other.

5. An image forming apparatus according to claim 4, further comprising a detector for judging a type of the transfer material, wherein a pressing force when the transfer material is an ordinary paper is stronger than a pressing force when the transfer material is other than the ordinary paper.

6. An image forming apparatus according to claim 4, wherein the pressing member is swingably provided around an axis positioned at the upstream side of the transfer charger with respect to the moving direction of the moving member.

7. An image forming apparatus, comprising:

an image bearing member;

a moving member holding a transfer material;

a transfer charger disposed in opposition to the image bearing member, the moving member positioning therebetween;

a pressing member disposed at the upstream side of the transfer charger with respect to a moving direction of the moving member, and movable between a pressing position where the pressing member presses the moving member to the image bearing member and a released position where the pressing member is freed therefrom;

a detector for recognizing where a rear edge of the transfer material carried by the moving member positions; and a driving device for moving the pressing member from the pressing position to the released position before the rear edge of the transfer material passes through a point where the image bearing member and the transfer charger oppose to each other.

8. An image forming apparatus according to claim 7, further comprising a detector for judging a type of the transfer material, wherein a pressing force when the transfer material is an ordinary paper is stronger than a pressing force when the transfer material is other than the ordinary paper.

9. An image forming apparatus according to claim 7, further comprising a detector for recognizing where a leading edge of the transfer material carried by the moving member positions, wherein the driving device moves the pressing member from the released position to the pressing position after the leading edge of the transfer material passes through the point where the image bearing member and the transfer charger oppose to each other.

* * * * *